US008967904B1

(12) United States Patent
Bub

(10) Patent No.: US 8,967,904 B1
(45) Date of Patent: Mar. 3, 2015

(54) TACTILE PLATE ASSEMBLY

(71) Applicant: Pioneer Detectable, LLC, Ixonia, WI (US)

(72) Inventor: Warren Bub, Hartland, WI (US)

(73) Assignee: Pioneer Detectable, LLC, Ixonia, WI (US)

( * ) Notice: Subject to any disclaimer, the term of this patent is extended or adjusted under 35 U.S.C. 154(b) by 0 days.

(21) Appl. No.: 13/646,050

(22) Filed: Oct. 5, 2012

(51) Int. Cl.
*E01C 11/02* (2006.01)
*E01C 5/00* (2006.01)

(52) U.S. Cl.
USPC ..... 404/19; 404/40; 52/582.1

(58) Field of Classification Search
USPC ..... 404/19, 35, 40, 41; 52/582.1
See application file for complete search history.

(56) References Cited

U.S. PATENT DOCUMENTS

| | | | | |
|---|---|---|---|---|
| 369,478 | A * | 9/1887 | Snow | 404/41 |
| 1,254,136 | A * | 1/1918 | Hastings | 52/583.1 |
| 4,274,626 | A * | 6/1981 | Grosser et al. | 482/23 |
| 4,848,058 | A * | 7/1989 | Mullen | 52/583.1 |
| 4,905,437 | A * | 3/1990 | Heather | 52/263 |
| 5,403,637 | A * | 4/1995 | Pickard et al. | 428/44 |
| 5,675,950 | A * | 10/1997 | Schilham | 52/263 |
| 6,189,289 | B1 * | 2/2001 | Quaglia et al. | 52/764 |
| 6,688,808 | B2 * | 2/2004 | Lee | 404/40 |
| 6,718,714 | B1 | 4/2004 | Montgomery, Sr. | |
| 6,763,643 | B1 * | 7/2004 | Mårtensson | 52/586.1 |
| 7,845,122 | B2 | 12/2010 | Sippola | |
| 7,980,042 | B2 * | 7/2011 | Polk, Jr. | 52/587.1 |
| 2010/0251640 | A1 * | 10/2010 | Franchini | 52/177 |
| 2011/0142539 | A1 * | 6/2011 | Sekine | 404/35 |

OTHER PUBLICATIONS

Detectable Warning Plates, Neenah Enterprises—Industrial, www.nfco.com.

* cited by examiner

*Primary Examiner* — Gary Hartmann
(74) *Attorney, Agent, or Firm* — Boyle Fredrickson, S.C.

(57) ABSTRACT

A tactile plate assembly used as a tactile warning device on walkways comprises a plurality of tactile plates with texture for providing tactile awareness. A connecting bracket attaches first and second tactile plates to each other to form a pair of tactile plates. Interlocking brackets, having first and second ends, attach two pairs of tactile plates together, forming a tactile plate subassembly. The interlocking brackets each includes a first end with a tab extending at an angle and a second end with a hole. The interlocking brackets can mate with one another to allow connection of multiple tactile plate subassemblies together. The interlocking brackets include multiple holes of sufficient size to allow a substrate such as concrete or asphalt to flow therethrough to anchor the tactile plate assembly in place. The connecting brackets may also include similar holes of sufficient size to allow a substrate to flow therethrough.

5 Claims, 9 Drawing Sheets

TACTILE PLATE ASSEMBLY

BACKGROUND OF THE INVENTION

1. Field of the Invention

The present invention relates to tactile plate assemblies used in walkways to alert pedestrians, including those with vision disabilities, of an upcoming intersection or other potentially dangerous area. The present invention also relates to brackets used to secure the individual tactile plates of a tactile plate assembly to the underlying substrate as well as to each other.

2. Discussion of the Related Art

As is known to those skilled in the art, intersections between walkways and streets, railway crossings, etc. can present potential hazards. Awareness of impeding traffic is very important for a pedestrian attempting to walk across or otherwise traverse such an area. Also, pedestrians who are hearing and/or vision impaired may not be aware of traditional safety warning devices such as crosswalk lights, painted markers, signs, or audible tones. Thus, a previously-recognized problem has been alerting such pedestrians that they are approaching intersections where automobiles, trains, or other hazards may be present.

Tactile plate assemblies sometimes are employed to address this problem. Tactile plate assemblies generally include a plurality of spaced projections and/or indentations that impart a texture to the walkway for providing a different feel to the walking surface as compared to the surrounding smooth walkway (e.g., sidewalks, etc.). The texture can be felt underfoot or perceived as bumpiness to a feeler cane or through the wheels of a wheelchair as it traverses the surface.

Tactile plate assemblies typically are formed from two or more subassemblies that are disposed next to one another. For example, two 2'×2' (0.3 m×0.6 m) subassemblies may be placed end-to-end to provide a 4'×2' (1.2 m×0.6 m) assembly. Multiple subassemblies are employed rather than a single larger assembly to maintain the aggregate weight that must be handled at any given time at a manageable level and to negate the need to cast large, thick plates. Such subassemblies typically are not interconnected and, thus, may become misaligned with one another either during installation or after.

In addition, traditional asphalt construction requires hot asphalt to be compressed with the use of weighted rollers or other compacting tamping devices. Prior tactile plate assemblies could not be used in conjunction with asphalt as they tend to move out of position and/or bend when the asphalt is compressed.

What is needed therefore is a warning device that effectively alerts pedestrians of potential hazards in the vicinity of walkway intersections. Also what is needed is a device to allow the warning device to be effectively set in curing concrete as well as asphalt. A manner to interconnect multiple warning devices to one another, allowing economical installation, increased stability, and increased rigidity in soft asphalt, is also needed. Heretofore, these requirements have not been fully met without incurring various disadvantages.

One previously recognized approach in an attempt to address one or more of the above-identified needs, involves connecting a safety flooring matrix to an underlying anchor box as disclosed in U.S. Pat. No. 6,718,714. Another approach in addressing one or more of these needs is disclosed in U.S. Pat. No. 7,845,122, which incorporates a tile that is connected to underlying flanges for distributing air pockets when the tile is placed on the ground.

These previous attempts remain deficient in addressing the issue of installing a warning device into curing asphalt as well as allowing an installer to effectively connect multiple warning devices to one another in an efficient manner.

SUMMARY OF THE INVENTION

Various implementations of the present invention are intended to address one or more of the above-identified needs, it being understood that various aspects of the invention as disclosed and claimed herein may be employed singly, in combination with each other, and/or as substitutes for each other. In its most basic form, the invention is directed to a tactile plate assembly made up of a plurality of tactile plates that are interlocked with one another and that each having a top surface and a bottom surface. The top surfaces of the tactile plates may include a series of textured features protruding from and/or indented into the top surface.

In accordance with one aspect of the invention, the tactile plates interlock with one another via one or more interlocking brackets. Each interlocking bracket attaches to the bottom surface of one or more tactile plates to form a subassembly. The interlocking brackets have ends that allow attachment to one another, allowing multiple interlocking brackets to be mated together, thus permitting an assembly to be formed from two or more subassemblies.

In accordance with another aspect of the invention, holes me be formed through the interlocking brackets. The holes are sized so as to be large enough to allow the substrate to flow or otherwise pass therethrough, thus anchoring the assembly to the substrate. The anchoring effect is particularly strong in the case of asphalt or concrete, which harden as they cure.

In order to further reinforce to the tactile plate assembly, multiple tactile plates may be secured to one another with connecting brackets. Preferably, a connecting bracket attaches on a first end to the bottom surface of a first tactile plate and on a second end to the bottom surface of a second tactile plate, pairing two tactile plates together. The pair of tactile plates may then be connected to one or more additional plates with interlocking brackets. Preferably, two interlocking brackets are provided at opposed sides of the paired tactile plates.

The connecting brackets may also assist in anchoring the tactile plate assembly in place. For use in asphalt applications, the connecting brackets preferably include a series of holes between each end of sufficient size to permit hot asphalt to flow therethrough. After the asphalt has cured, the holes effectively anchor the tactile plate assembly in place.

The interlocking brackets preferably can be coupled to one another without the use of tools, such as through the use of mating male and female connectors. For example, each of the interlocking brackets may have a tab extending at an angle from the first end, and a hole on the second end. This configuration allows the tab of a first interlocking bracket to be inserted into the hole of a second interlocking bracket, thus interlocking the first and second brackets.

In accordance with yet another aspect of the invention, a method is provided of assembling a tactile plate assembly. The method includes fastening a first interlocking bracket, having a first end and a second end, to a first tactile plate with a top surface and a bottom surface. The method further includes fastening a second interlocking bracket, having a first end and a second end, to a second tactile plate with a top surface and a bottom surface, and mating the first end of the first interlocking bracket to the second end of the second interlocking bracket. The mating operation may include positioning the first and second interlocking brackets at an angle relative to one another, inserting a tab on the first end of the first interlocking bracket into a hole in the second end of the second interlocking bracket, and pivoting the first and interlocking second brackets relative to one another to a position in which the first and second interlocking brackets are aligned with one another and the tab on the first interlocking bracket locks into the hole in the second interlocking bracket.

Other features of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
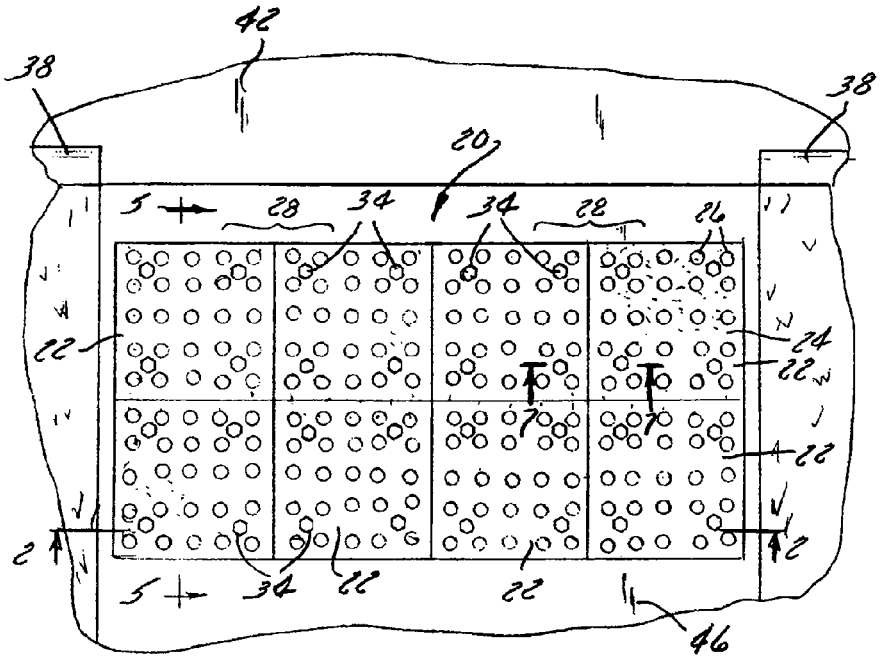
FIG. 1 is a top plan view of a tactile plate assembly constructed in accordance with a first embodiment of the invention, installed in a concrete sidewalk.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION OF THE PREFERRED EMBODIMENT

Figure 2:
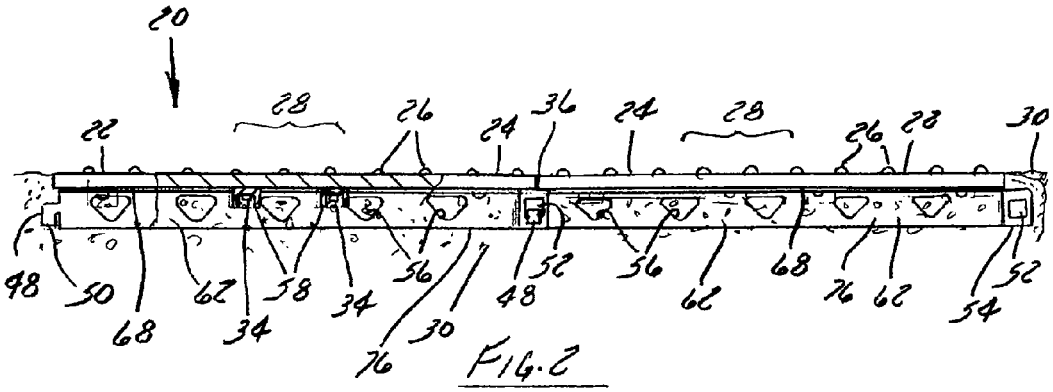
FIG. 2 is a cross sectional side elevation view of the tactile plate assembly of FIG. 1, taken generally along section line 2-2 in FIG. 1.

As shown in FIG. 1, a tactile plate assembly 20 constructed in accordance in a first embodiment of the invention is installed in a substrate in the form of a walkway 46 such as sidewalk. Typically, the tactile plate assembly 20 is positioned in the walkway 46 proximate to a street 42 and just before the street curb 38. The walkway 46 of this embodiment is formed from concrete. As shown in FIGS. 1 and 2, the tactile plate assembly 20 lies substantially flush with the surface of the surrounding walkway 46.

The tactile plate assembly 20 illustrated in FIG. 1 is composed of two subassemblies 28 interlocked together and then anchored in the walkway 46. Each subassembly 28 has a plurality of interconnected tactile plates 22. In the illustrated embodiment, each subassembly 28 has four tactile plates 22 coupled to one another by at least one laterally-extending connecting bracket 58 and at least one longitudinally interlocking bracket 62. The longitudinally extending interlocking brackets 62 of the subassemblies 28 are interlocked with one another to form the completed tactile plate assembly 20. In the illustrated embodiment, each tactile plate 22 is 1'×1' (0.3 m×0.3 m) square. The tactile plate assembly 20 thus is 4' (1.2 m) long×2' (0.6 m) wide and is formed from two 2' (0.6 m)×2' (0.6 m) subassemblies 28.

It should be noted, however, that plates of different dimensions and even different proportions could be used without departing from the spirit and scope of the invention. For example, the connecting brackets 58 could be eliminated and an assembly having the illustration dimensions could be formed from two 2' (0.6 m)×2' (0.6 m) tactile plates 22 placed end-to-end. However, particularly if the tactile plates 22 are made from cast iron, smaller plates are preferred because the plates can be made substantially thinner, and therefore lighter, without introducing an unacceptable amount of warpage.

Figure 3:
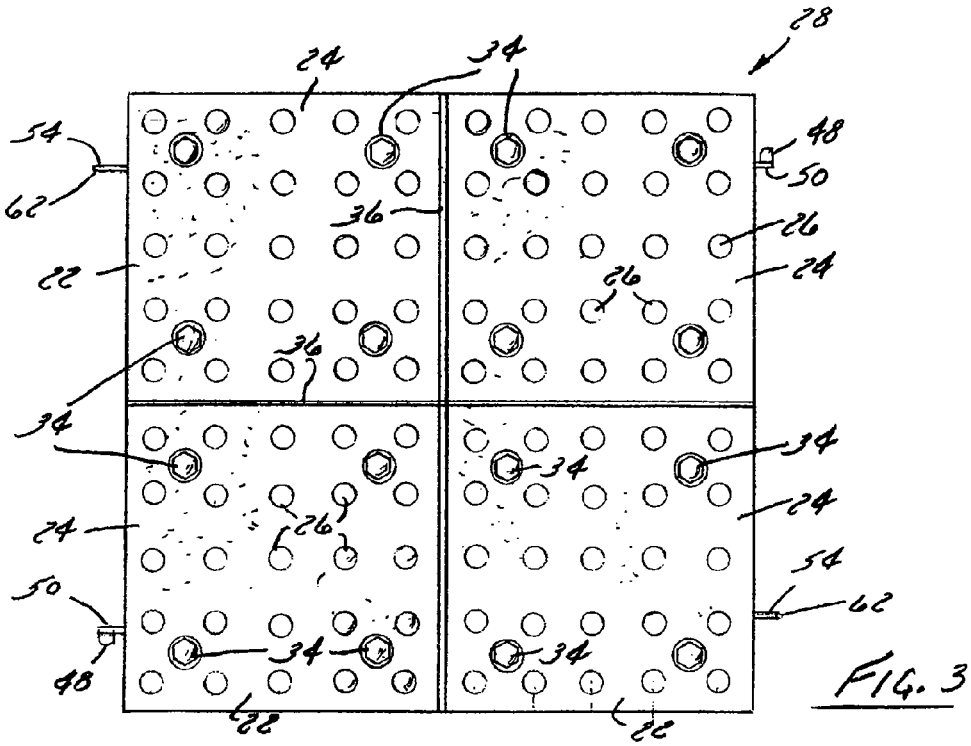
FIG. 3 is a top plan view of a subassembly of the tactile plate assembly of FIG. 1.

Each of the tactile plates 22 is formed from a durable material, preferably cast iron. Referring to FIGS. 1-3, the top surface 24 of each tactile plate 22 is textured so as to provide a tactile warning surface used to alert pedestrians of an upcoming intersection or other potentially dangerous area. The tactile warning surfaces preferably include a plurality of spaced projections 26 that provide a different feel to the walking surface as compared to the surrounding smooth walkway 46. The projections can be felt underfoot or perceived as bumpiness to a feeler cane or through the wheels of a wheelchair as it traverses the surface. The projections 26 of this embodiment comprise domes arranged in parallel rows. The bottom surface 69 of each tactile plate 22 may be reinforced with a pattern of stiffening ribs 27 cast integrally with the tactile plate.

Figure 4:
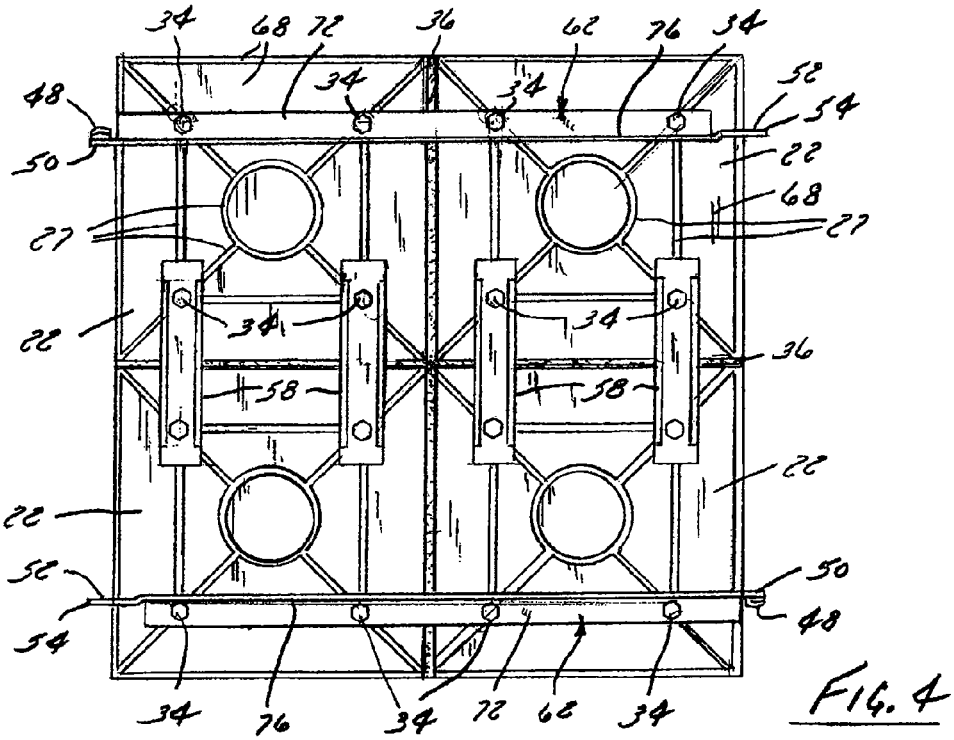
FIG. 4 is a bottom plan view of the tactile plate subassembly of FIG. 3.
Figure 5:
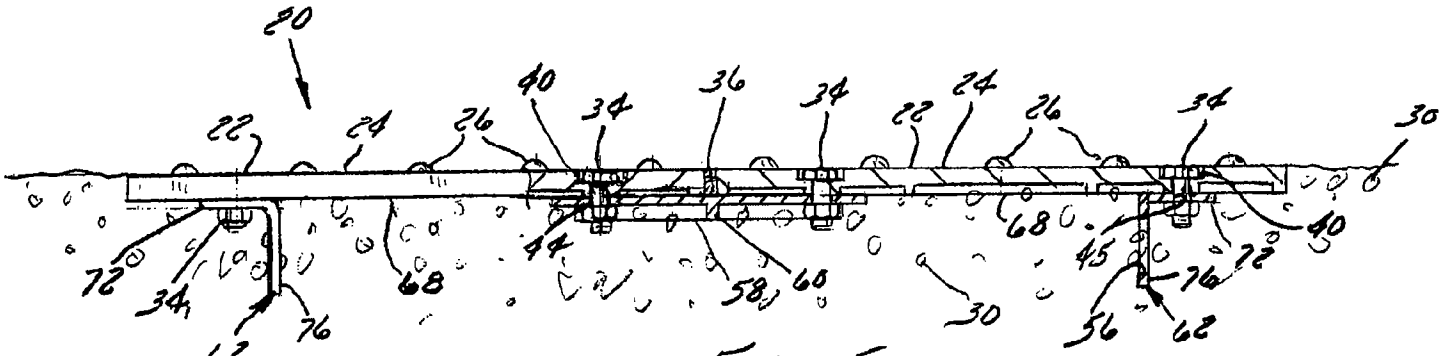
FIG. 5 is cross sectional end elevation view taken generally along section line 5-5 of FIG. 1.

Referring generally to FIGS. 2-5 and to FIGS. 4 and 5 in particular, the four tactile plates 22 of each subassembly 28 of this embodiment are held together with two laterally extending, longitudinally spaced connecting brackets 58 and two longitudinally extending, laterally spaced interlocking brackets 62 attached to the bottom surfaces 69 of the tactile plates 22 as best seen in FIG. 4. Thus, the laterally adjacent tactile plates 22 of each subassembly 28 are coupled to one another and reinforced by two connecting brackets 58, and each pair of longitudinally adjacent tactile plates 22 of each subassembly 28 are connected to one another and reinforced by two interlocking brackets 62. Of course, a smaller or larger number of each type of bracket could be employed, if desired. A sealant 36 may be applied in the seams between the adjacent tactile plates 22 of each subassembly 28 and/or between the plates of adjacent subassemblies. This sealant 36 prevents the underlying substrate 30, such as wet cement or hot asphalt, from seeping up in between the tactile plates 22 when the tactile plate assembly 20 is installed into the walkway 46 and also prevents infiltration of water or other foreign matter once the tactile plate assembly 20 is set into the concrete walkway 46.

Figure 7:
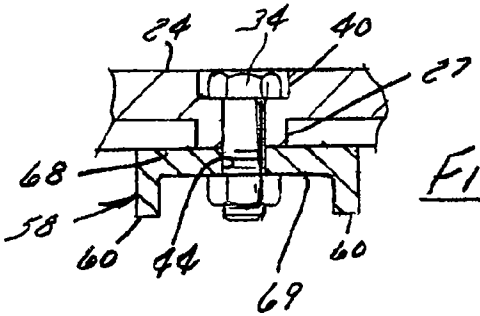
FIG. 7 is a cross sectional end view taken generally along section line 7-7 of FIG. 1.
Figure 6:
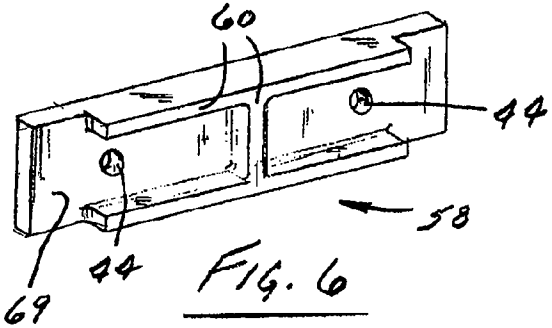
FIG. 6 is a perspective view of a connecting bracket of the tactile plate assembly of FIGS. 1, 2, and 5.

The connecting brackets 58 preferably are selected based on the underlying substrate in which the tactile plate assembly 20 is to be installed. In the illustrated embodiment in which the tactile plate assembly 20 is intended to be installed in concrete, each connecting bracket 58 takes the configuration illustrated in FIGS. 4-7. Specifically, each connecting bracket 58 is about 8.5" (215.9 mm) long×1.3" (3 mm) wide and is formed from a rigid material such as cast iron. Each connecting bracket 58 has a planar upper surface and at least two spaced apertures 44 for receiving bolts 34 or other fasteners for attaching the connecting bracket 58 to the associated tactile plates 22. The bolts 34 extend downwardly through counterbored holes 40 located between the projections 26 in the tactile plates 22 and though the mating apertures 44 in the connecting brackets 58 as best seen in FIG. 7. Referring especially to FIGS. 6 and 7, each connecting bracket 58 preferably is reinforced by downwardly reinforcing ribs 60 that extend downwardly from the bottom surface 69 of the main body of the connecting bracket 58. The ribs 60 combine to take the shape of an "H."

Referring now to FIGS. 2-5 and 8-10, the interlocking brackets 62 are configured to 1) interconnect and reinforce the associated pairs of longitudinally-adjacent tactile plates 22 of each subassembly 28, 2) assist in anchoring the tactile plate assembly 20 in place within the underlying subassembly, and 3) interlock adjacent subassemblies 28. The interlocking function preferably can be performed without the use of any tools such as through the mating interaction of male couplers 50 and female couplers 54 on the ends of the adjacent interlocking brackets 62. If two interlocking brackets 62 are provided on each subassembly 28, they preferably are arranged in a mirror-image fashion so that one female coupler 54 and one male coupler 50 will be present on each end of each subassembly 28 as best seen in FIGS. 3 and 4.

Figure 9:
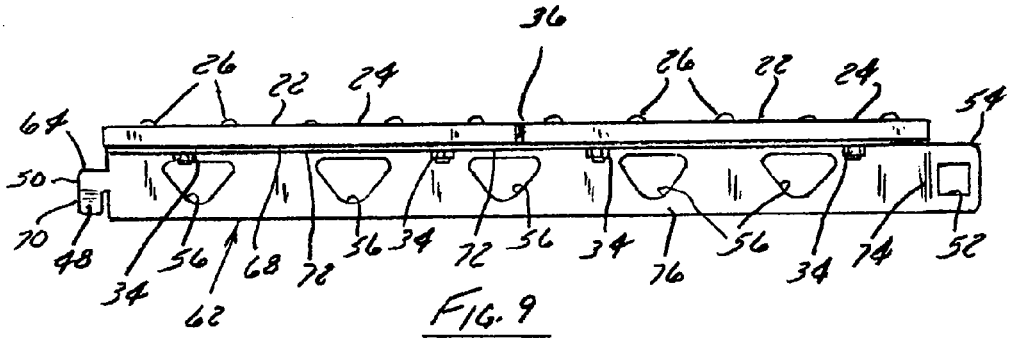
FIG. 9 is a side elevation view of the tactile plate subassembly of FIG. 3.
Figure 10:
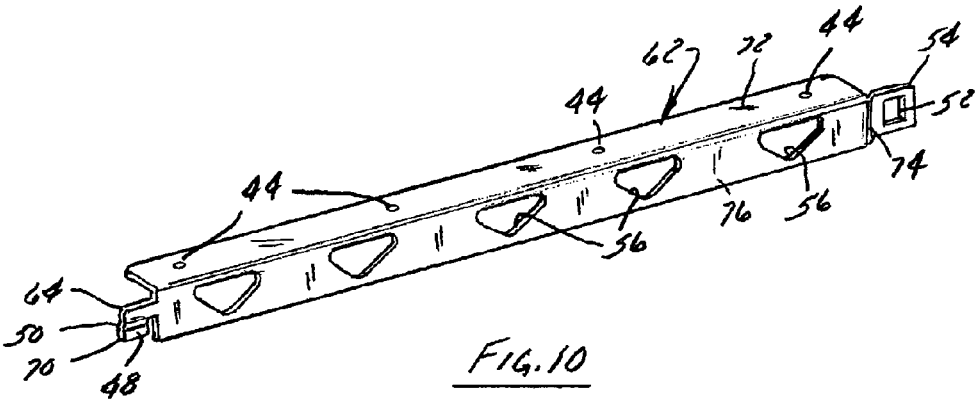
FIG. 10 is a perspective view of an interlocking bracket of the tactile plate subassembly of FIG. 3.

Referring especially to FIGS. 9 and 10, each interlocking bracket 62 of this embodiment comprises an L-bracket formed from a rigid metal such as steel. Each interlocking bracket 62 includes a horizontal base leg 72 and a vertical anchor leg 76. The base leg 72 has plurality of spaced apertures 44 for receiving fasteners in the form of bolts 34 that extend downwardly through mating counterbored holes 40 in the tactile plates 22 (see FIG. 5.) Spaced holes 56 formed in the anchor leg 76 assist in anchoring the tactile plate assembly 20 as discussed above and as shown best in FIGS. 2 and 5. These holes 56 thus should be sufficiently large to permit concrete or asphalt to pass freely through them in a volume that securely anchors the tactile plate assembly 20 in place when the concrete or asphalt cures. In the illustrated example, the holes 56 are generally triangular in shape and have a base of approximately 2" (50.8 mm) and a height of approximately 1.25" (31.75 mm). Five such holes 56 are evenly spaced along the length of the anchor leg 76. If desired, laterally extending reinforcing rods (not shown) could be inserted through one or more sets of aligned holes 56 in the opposed interlocking brackets 62 of each subassembly 28. Each reinforcing rod could have a generally triangular shape and dimensioned so as to be received snugly in the holes 56. The opposed ends of each reinforcing rod could be attached to the respective interlocking brackets 62 and possibly to the tactile plates to prevent the interlocking brackets 62 from bowing out or otherwise bending.

Figure 8:
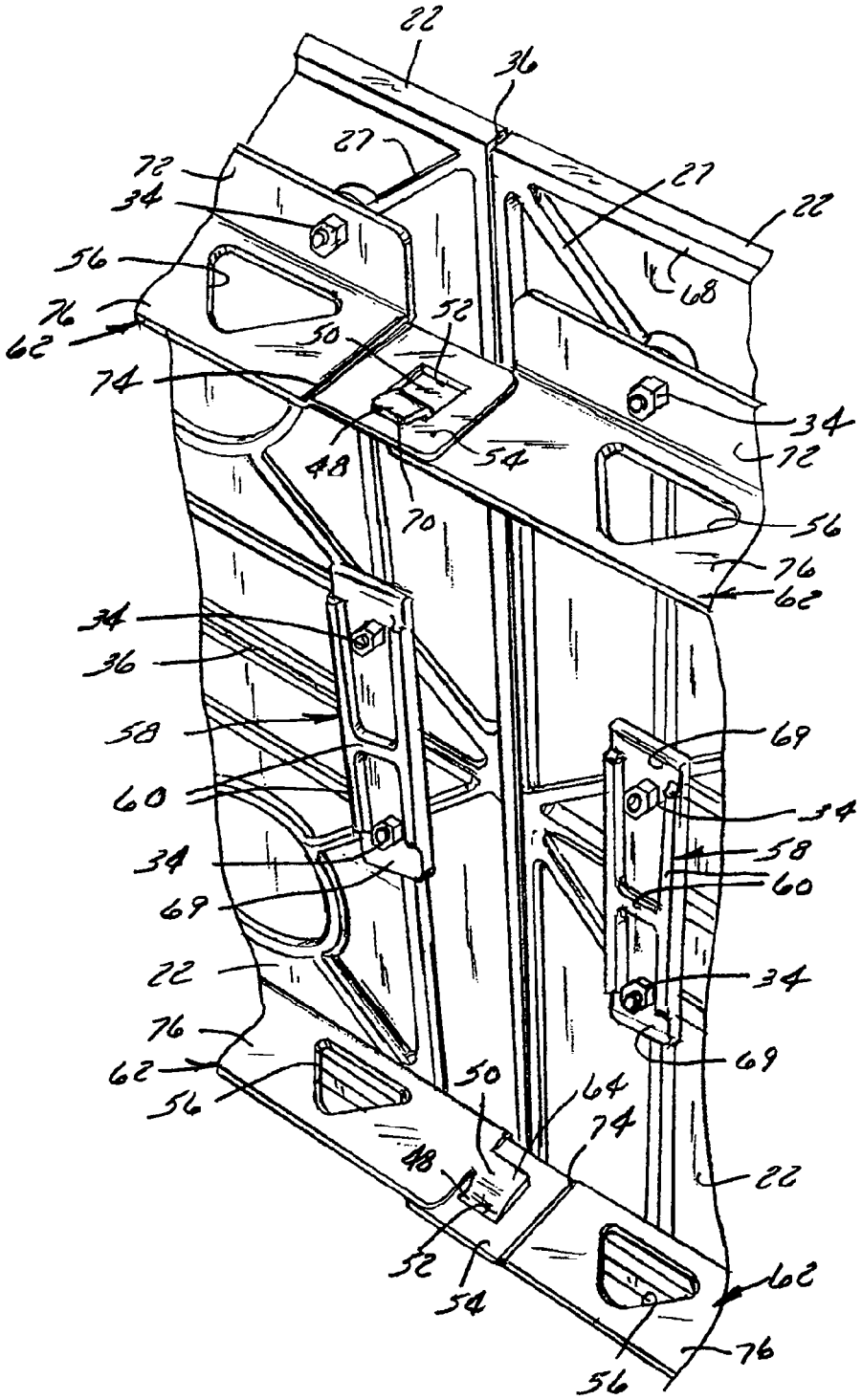
FIG. 8 is a partial perspective view of the bottom surface of the tactile plate assembly of FIG. 1.

Referring especially FIGS. 8-10, each of the male couplers 50 and the female couplers 54 of this embodiment comprises a tab 48 and a hole 52 formed on the first and second ends, respectively, of each interlocking bracket 62. Each male coupler 50 and each female coupler 54 is formed on or in an extension of the anchor leg 76 extending beyond the corresponding end of the tactile plate subassembly 28.

Still referring to FIGS. 8-10, the tab 48 of each interlocking bracket 62 is punched out of the extension of the first end of the associated anchor leg 76 of that interlocking bracket 62. The tab 48 has a width of about 0.72" (18.29 mm) and has an inner end 64 and an outer end 70. The inner end 64 is about 0.26" (6.6 mm) long and extends inwardly from the anchor leg 76 at an angle of about 32°. The outer end 70 is about 0.45" (11.43 mm) long and extends at an angle of about 45° relative to the anchor leg 76 of the interlocking bracket 62 or of about 13° relative to the inner end 64 of the tab 48. This configuration permits the tab 48 to lock into the mating hole 52 of the adjacent interlocking bracket 62. The hole 52 of each female coupler 54 on each interlocking bracket 62 is cut out of the extension of the second end of the anchor leg 76 of the associated interlocking bracket 62. It is generally square, having a length of about 1" (25.4 mm) on a side. The female coupler 54 bearing the hole 52 has a slight offset 74 relative to the adjacent portion of the anchor leg 76 to accommodate the tab 48 of the adjacent interlocking bracket 62 as discussed below.

Turning now to FIG. 8, the manner in which the interlocking brackets 62 mate with one another is shown. The angled nature of the tab 48 on the male coupler 50 in effect produces a hook-like projection. This projection is inserted through the hole 52 located on the female coupler 54 of a second interlocking bracket 62.

Figure 11:
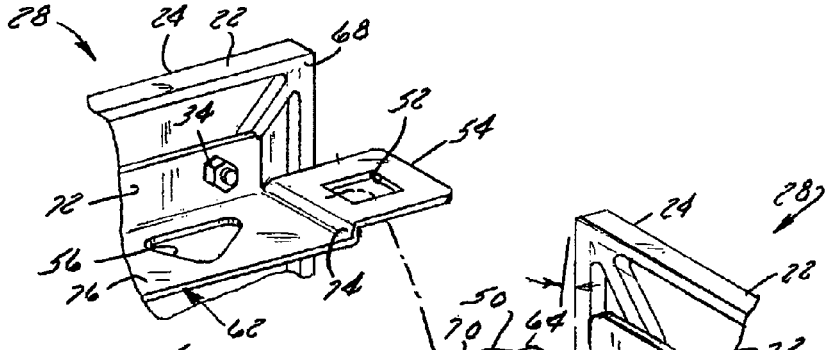
FIGS. 11-13 are a series of perspective views illustrating the manner in which adjacent interlocking brackets of the tactile plate assembly of FIGS. 1, 2, and 5 interlock with one another.
Figure 12:
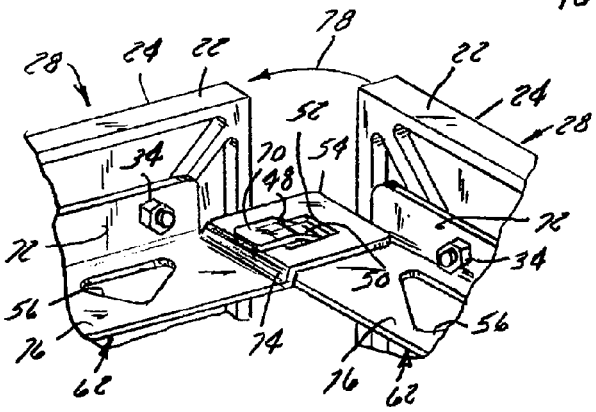
Figure 13:
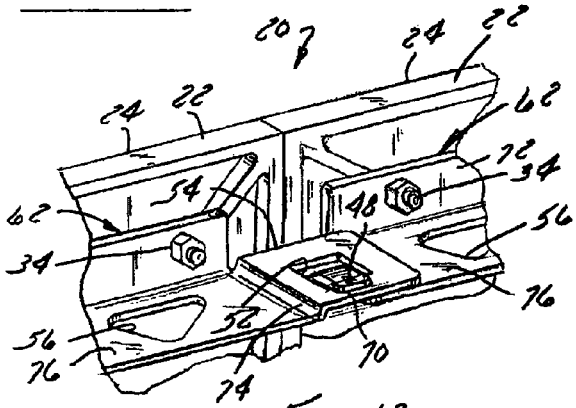

FIGS. 11-13 further detail the manner in which the interlocking brackets 62 of first and second subassemblies 28 connect to one another. Preferably, the first subassembly 28 is positioned proximate to the second subassembly 28 so that the ends of the subassemblies are at an angle to one another. This angle preferably is about 90° but could be greater or smaller depending, for instance, on what is required to accommodate varying dimensions of the tabs 48 and holes 52. The tabs 48 are then inserted through the holes 52 in the mating interlocking brackets 62 as seen in FIG. 12. After the tab 48 is inserted into the hole 52, the subassemblies 28 are rotated in the direction of arrow 78 in FIG. 12 to position the top surfaces 24 of the tactile plate 22 coplanar with one another, as seen in FIG. 13. This rotating motion allows each tab 48 to lock into position within the corresponding hole 52. The above-described offset 74 of the female coupler 54 on the second end of each of the anchor legs 76 allows the interlocking brackets 62 to connect to one another as shown in FIG. 13 while keeping the interlocking brackets 62 in line with one another.

While only one pair of interlocking brackets 62 on one side of the assembly 20 is disclosed in FIGS. 11-13, the same procedure is utilized on the interlocking brackets 62 located on the opposite side of the assembly 20. However, as mentioned briefly above, each subassembly 28 has a tab 48 and a hole 52 on one end of the subassembly 28 with the reverse orientation on the opposite end in order to facilitate this interlocking motion. This configuration is best shown in FIGS. 3 and 4. Configuring the ends of the interlocking brackets 62 in this manner prevents the tabs 48 from binding in the holes 52 when the subassemblies 28 are interlocked.

Figure 14:
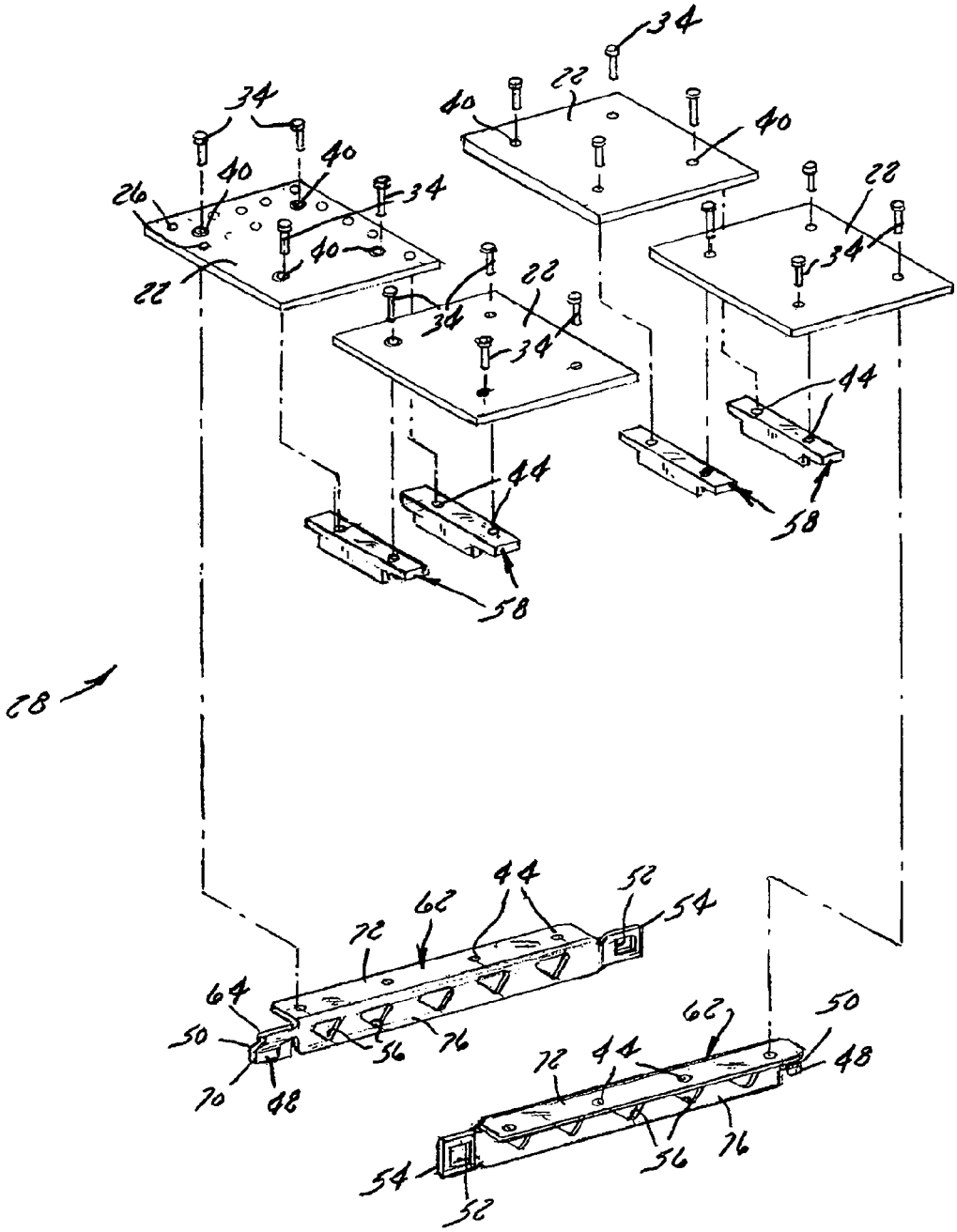
FIG. 14 is an exploded perspective view of the tactile plate subassembly of FIG. 3.

An exploded view of the subassembly 28 of FIGS. 3 and 4 is shown in FIG. 14. Illustrating the subassembly 28 in exploded view highlights an advantage of using bolts 34 or similar fasteners to connect the various components of the subassembly 28 rather than welding them or using other non-detachable means to fix them together. Specifically, using bolts 34 as the preferred fastener permits an individual tactile plate 22 to be removed from the tactile plate assembly 20 and replaced with a new one without disturbing the underlying substrate 30. Manufacturing the tactile plate assembly 20 in one piece, for example by casting, or permanently affixing the interlocking brackets 62 or connecting brackets 58 to the tactile plates 22 would require the underlying substrate 30 to be disturbed in order to remove and replace a tactile plate 22.

Figure 15:
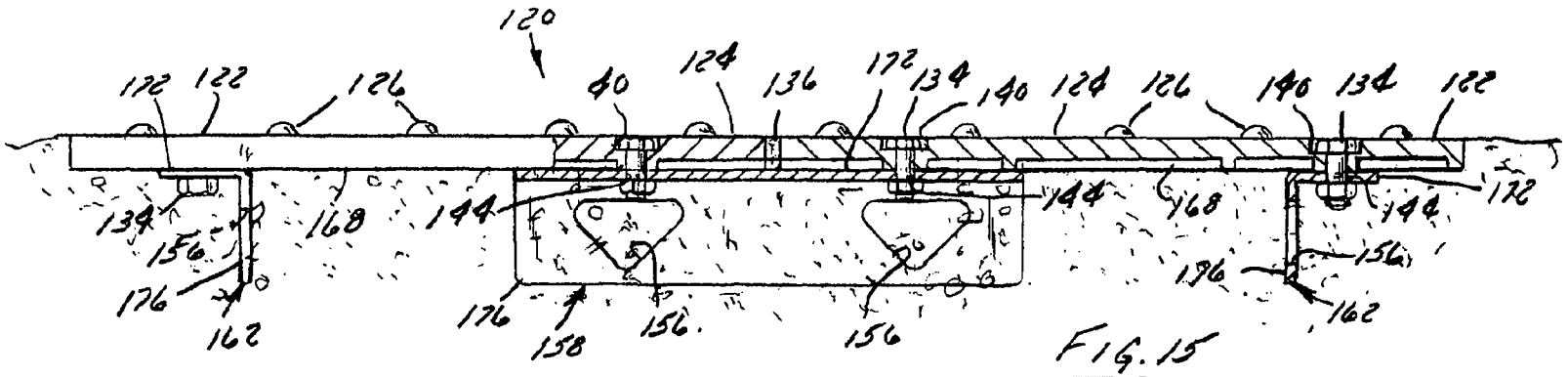
FIG. 15 is a partial cross sectional end elevation view of a tactile plate assembly constructed according to a second embodiment of the invention and installed in asphalt.
Figure 16:
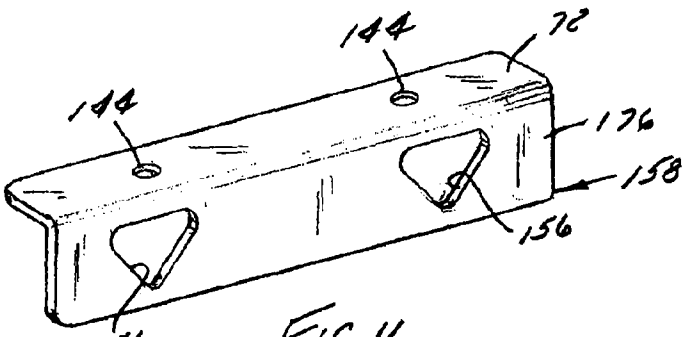
FIG. 16 is a perspective view of a connecting bracket of the tactile plate assembly if FIG. 15.
Figure 17:
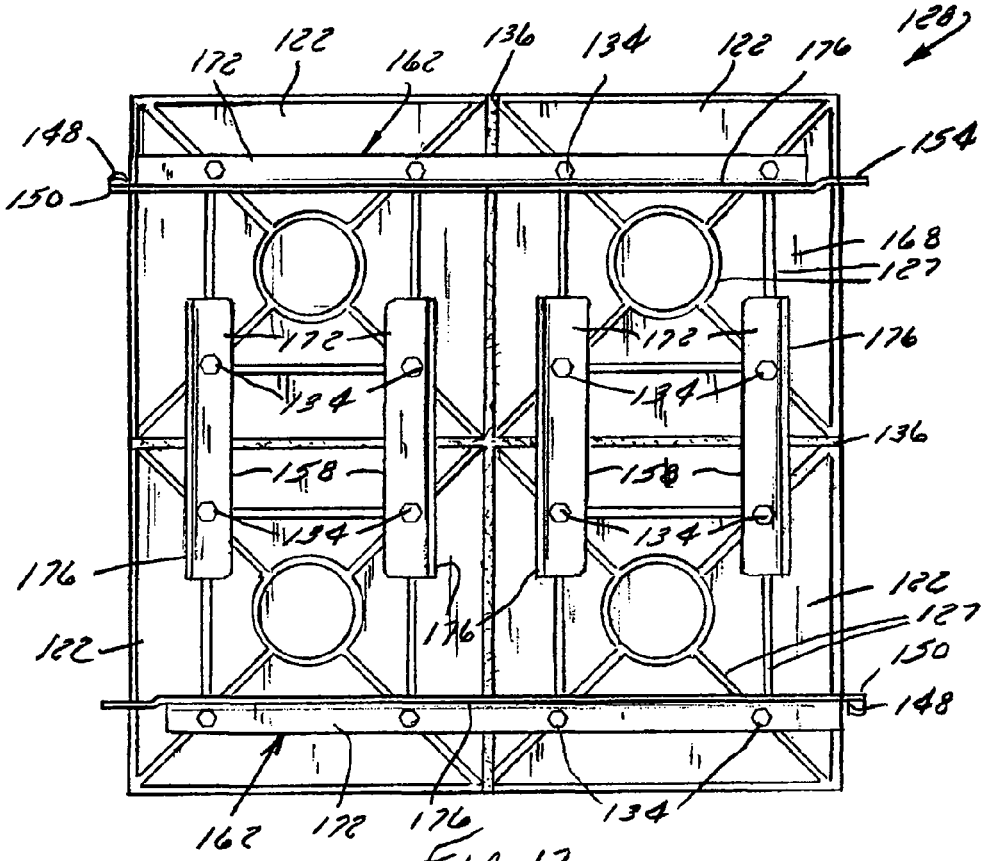
FIG. 17 is a bottom plan view of a subassembly of the tactile plate assembly of FIG. 15.

Referring now to FIGS. 15-17, an embodiment of a tactile plate assembly 120 is illustrated that differs from the embodiment of FIGS. 1-14 only in that the connecting brackets 58 of the first embodiment are replaced by asphalt connecting brackets 158 permitting the installation of the tactile plate assembly 120 in asphalt. Elements of the embodiment of FIGS. 15-17 corresponding to elements of FIGS. 1-14 therefore are designated by the same reference numerals, but increased by an increment of 100. A separate description of all elements except for the asphalt connecting brackets 158 will be omitted for the sake of conciseness.

The connecting brackets 158 of this embodiment differ conceptually from the connecting brackets 58 of the first embodiment in that 1) they are designed to provide increased reinforcement at the central portion of the associated tactile plate assembly 120 and 2) they are designed to provide additional anchoring in the underlying substrate 130. The asphalt connecting bracket 158, detailed in FIG. 16, is L-shaped so as to have a horizontal base leg 172 and a vertical anchor leg 176. The base leg 172 has apertures 144 for receiving fasteners, preferably bolts 134, for attachment to the bottom surfaces 168 of the tactile plates 122 just as disclosed above with reference to FIGS. 5-7. The bolts 134 may be passed through counterbored holes 140 in the tactile plates 122 and then through the apertures 144 in the asphalt connecting brackets 158. The anchor leg 176 includes a plurality of holes 156 large enough to allow the asphalt to flow therethrough. In the illustrated embodiment in which the connecting bracket 158 is about 8.5" (215.9 mm) long, two such holes 156 are provided in the connecting bracket 158 near respective ends thereof. Each of these holes 156 may, if desired, may be identical in size and shape to the corresponding holes 156 in the interlocking brackets 162. These holes 156 utilize the same principle disclosed above with reference to the holes 156 in the anchor legs 176 of the interlocking brackets 162.

As discussed above, when the tactile plate assembly 120 is set into a substrate 130 such as hot asphalt, the asphalt flows through the holes 156 on the interlocking brackets 162 as well as through the holes 156 in the asphalt connecting brackets 158. A weight is then typically applied to the top surface 124 of the tactile plate assembly 120, typically using a tamping device or a roller. Due to the connection formed by mating multiple subassemblies 128 to one another, as shown in FIGS. 11-13, the tactile plate assembly 120 remains rigid and in one solid piece while the weight is applied to the top surface 124. This prevents each tactile plate 122 for moving out of position as the weight is moved along the top surface 124 of the tactile plate assembly 120 and also prevents the tactile plate assembly 120 from bending or bowing at its center.

Moving on to FIG. 17, a subassembly 128 is shown with the above-mentioned asphalt connecting brackets 158. The asphalt connecting brackets 158 and the interlocking brackets 162 are attached to the tactile plates 122 in identical fashion as shown and described with reference to FIGS. 3 and 4. Furthermore, multiple subassemblies 128, as shown in FIG. 17, may be connected to one another in the same fashion as is shown and disclosed with reference to FIGS. 11-13.

Although the best mode contemplated by the inventor of carrying out the present invention is disclosed above, practice of the present invention is not limited thereto. It will be manifest that various additions, modifications, and rearrangements of the features of the present invention may be made without deviating from the spirit and scope of the underlying inventive concept. Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A method of assembling a tactile plate assembly including:

fastening a first interlocking bracket, having a first end and a second end, to a first tactile plate having a top surface and a bottom surface;

fastening a second interlocking, bracket, having a first end and a second end, to a second tactile plate having a top surface and a bottom surface;

mating the first end of the first interlocking bracket to the second end of the second interlocking bracket so as to interlock the first and second interlocking brackets to one another;

positioning the first and second interlocking brackets at an angle relative to one another;

inserting a tab extending at an angle from the first end of the first interlocking bracket into a through-hole in the second end of the second interlocking bracket; and pivoting the first and second interlocking brackets relative to one another to a position in which the first and second interlocking brackets are aligned with one another and the tab on the first interlocking bracket locks into the through-hole in the second interlocking bracket.

2. The method of claim 1, further including the steps of:

fastening a first end of a first connecting bracket to the bottom surface of the first tactile plate;

fastening a second end of the first connecting bracket to a bottom surface of the third tactile plate;

fastening a third connecting bracket, having a first end and a second end, to the bottom surface of the third tactile plate;

fastening a fourth connecting bracket, having a first end and a second end, to the bottom surface of the fourth tactile plate; and mating the first end of the third interlocking bracket to the second end of the fourth interlocking bracket.

3. The of claim 2, wherein the step of mating the first interlocking bracket to the second interlocking bracket and mating the third interlocking bracket to the fourth interlocking bracket includes the steps of:

positioning the first and third tactile plates at an angle to the second and fourth tactile plates;

inserting a tab on the first end of each of the first and fourth interlocking brackets into a corresponding through-hole in the second end of each of the second and third interlocking brackets, respectively, and pivoting the first and third interlocking brackets relative to the second and fourth interlocking brackets to a position in which the first and third interlocking brackets are aligned with the second and fourth interlocking brackets, respectively, and the tabs on the first and fourth interlocking brackets lock into the through-holes in the second and third interlocking brackets, respectively.

4. The method of claim 2, further including the steps:

setting the bottom surfaces of the tactile plates and the interlocking brackets into a substrate;

applying a weight to the top surfaces of the tactile plates; and flowing the substrate through a plurality of holes in the interlocking brackets.

5. The method of claim 4, wherein the substrate is asphalt, and further including flowing the substrate through a plurality of holes in the connecting brackets, and keeping the tactile plates interlocked with each other when applying the weight to the top surfaces of the respective tactile plates.

* * * * *